US011615704B2

(12) United States Patent
Kijashka

(10) Patent No.: US 11,615,704 B2
(45) Date of Patent: Mar. 28, 2023

(54) TRAFFIC LIGHT ASSEMBLY

(71) Applicant: ESKP3 PTY LTD, Forest Lake (AU)

(72) Inventor: Elizabeth Abigael Kijashka, Forest Lake (AU)

(73) Assignee: ESKP3 PTY. LTD., Forest Lake (AU)

( * ) Notice: Subject to any disclaimer, the term of this patent is extended or adjusted under 35 U.S.C. 154(b) by 0 days.

(21) Appl. No.: 17/594,807

(22) PCT Filed: May 1, 2020

(86) PCT No.: PCT/AU2020/050433

§ 371 (c)(1),
(2) Date: Oct. 29, 2021

(87) PCT Pub. No.: WO2020/220089

PCT Pub. Date: Nov. 5, 2020

(65) Prior Publication Data

US 2022/0208001 A1 Jun. 30, 2022

(30) Foreign Application Priority Data

May 2, 2019 (AU) ..... 2019901493
Jun. 5, 2019 (AU) ..... 2019901944

(51) Int. Cl.
*G08G 1/07* (2006.01)

(52) U.S. Cl.
CPC ..... *G08G 1/07* (2013.01)

(58) Field of Classification Search
CPC ..... G08G 1/07; G08G 1/095; G08G 1/00; G08G 1/096; G09F 13/0472; G09F 19/20; G09F 2013/222
See application file for complete search history.

(56) References Cited

U.S. PATENT DOCUMENTS 6,072,407 A 6/2000 Shin
6,850,169 B2 2/2005 Manavi et al.
7,006,011 B1 2/2006 Colby
2003/0048201 A1 3/2003 Weiss et al.
(Continued)

FOREIGN PATENT DOCUMENTS

CA 1062676 A 9/1979
CA 1266459 A 3/1990
(Continued)

OTHER PUBLICATIONS

IP Australia, Australian Application No. 2020266877, "Notice of acceptance for your patent application," dated Nov. 8, 2021.

*Primary Examiner* — Sisay Yacob
(74) *Attorney, Agent, or Firm* — Culhane Meadows PLLC

(57) ABSTRACT

A traffic light assembly is disclosed with red, amber and green lights. While light is being emitted, a flashing sequence pattern is generated within the area to enhance the meaning of the signal communicated to the driver. The sequence pattern is formed by changing the colour of light emitted, and or by ceasing to emit light. An intermediate pattern that is different in configuration from any of the sequence patterns is provided at a transition between at least one of the red, amber and green lights to further communicate to the driver that the light signal is about to change and that action is about to be required.

14 Claims, 4 Drawing Sheets

(56) References Cited

U.S. PATENT DOCUMENTS

| | | | | |
|---|---|---|---|---|
| 2005/0218834 | A1* | 10/2005 | Chen | G08G 1/096 315/291 |
| 2008/0136671 | A1* | 6/2008 | Shen | G08G 1/096 340/907 |
| 2009/0135024 | A1* | 5/2009 | Park | G08G 1/095 340/929 |
| 2009/0284393 | A1* | 11/2009 | Ochiai | G09F 9/33 340/815.45 |
| 2010/0315264 | A1 | 12/2010 | Tarolli | |
| 2017/0243073 | A1 | 8/2017 | Raghu et al. | |

FOREIGN PATENT DOCUMENTS

| | | | |
|---|---|---|---|
| GB | 2044973 | A | 10/1980 |
| JP | 2005182625 | A | 7/2005 |
| WO | 2004109620 | A1 | 12/2004 |
| WO | 2007045180 | A1 | 4/2007 |

* cited by examiner

TRAFFIC LIGHT ASSEMBLY

PRIORITY

This patent application is a national phase filing under section 371 of PCT/AU2020/050433, filed on May 1, 2020, which claims the priority of Australian patent application 2019901493, filed on May 2, 2019 and Australian patent application 2019901944 filed on Jun. 5, 2019, each of which is hereby incorporated by reference in its entirety.

TECHNICAL FIELD

The present invention relates to a traffic light assembly providing a signal system. The traffic light assembly can be used to control the flow of traffic on roads or in other areas where management of traffic is required such as but not limited to factories, airports, bus stations and other transport hubs. Also disclosed is a method for controlling driverless vehicles using the traffic light assembly of the invention.

BACKGROUND

The current landscape near traffic light signals is not always conducive to gaining the drivers attention. The roadside is often cluttered with place names, advertising signs including neon signs and temporary road changes such that the driver is not always fully aware of the actual traffic light signals within this background of jumbled flotsam.

Hence, the driver of a vehicle may not always be approaching traffic light signals at a safe speed to obey the displayed signals. Sometimes, despite the best of intentions, the driver gets caught out disobeying a displayed signal because they become aware of the requirement to alter their driving when they are already upon (and just then notice) the signal.

Red light running in Australia and other parts of the world is a major problem and causes many accidents. Running a red light can occur just as the traffic light signal is turning red, or when the light has been red for some time. Arguably, it becomes a more deliberate illegal (and dangerous) action if the driver runs a red light when the signal has been red for some time. The direct defiance of such a signal should not only attract a fine, but also could attract a higher point penalty to bring home the message that Stop means Stop.

Some motorists have trouble obeying signals if they cannot see (or choose not to see) the signals. Some motorists might be distracted, tired and or incompetent and may dismiss the meaning of traffic light signals to suit their circumstances. These motorist appear to manage too often to run the red lights or fail to slow down at amber lights.

Colour blinded motorists can have difficulty distinguishing between red and green colours to varying degrees and this can also contribute to an inability to obey traffic light signals.

Autonomous vehicles, such as driverless vehicles, are those vehicles which are capable of sensing the environment and then drive with little or no human input. It is important the driverless vehicle adhere to the road rules, and in relation to traffic signals, the driverless vehicle should respond to the signals without delay. Typically, the driverless vehicle will have one or more sensors that detect traffic signals and respond to them accordingly.

In some areas, all of the vehicles are driverless vehicles and it is important the vehicles are all working of a single system that allows each vehicle to behave predictably and within prescribed time periods around the other vehicles.

There exists a need for an improved traffic light signal system that assists drivers (including sensors in driverless vehicles) in understanding the actions required to be taken. Advantageously, this system would also help colour blind motorists to more efficiently obey the traffic light signals.

SUMMARY OF INVENTION

In a first aspect there is provided a traffic light assembly comprising a light signal adapted to emit red, amber and green light in a sequence; the light signal being capable of communicating to a driver by a change in colour that an action is required to be undertaken at a location on a road;

wherein the light signal comprises an area from which light is emitted;

while the light is being emitted, a flashing sequence pattern is generated within the area to enhance the meaning of the signal communicated to the driver;

the sequence pattern being formed by changing the colour of some of the light being emitted, and or by ceasing to emit some of the light, and so that the sequence pattern displayed during emission of red, amber or green light is different in each configuration wherein an intermediate visual that is different in configuration from any of the sequence patterns is provided in the area at a transition between at least one of the red, amber and green lights in the sequence to further communicate to the driver that the light signal is about to change and that action is about to be required.

In an embodiment, the flashing sequence pattern displayed during emission of red, amber or green light comprises at least one of a flashing circle, a flashing cross and a flashing chevron. In an embodiment, the flashing is by inclusion of light of a contrasting colour provided in the context of the background of the red, amber or green light. In an embodiment, the flashing is by the absence of light provided in the context of the background of the red, amber or green light.

In an embodiment, the flashing sequence pattern displayed during emission of red, amber or green light comprises:

when the light is red, at least one preferably two; flashing circle or cross patterns within the area intended to communicate a stop action to the driver;

when the light is amber at least one flashing circle pattern within the area intended to communicate a stop action to the driver;

wherein when the light is green there are chevrons moving over the area intended to communicate a move forward action to the driver.

The driver can be a driver of a vehicle. The term driver can refer to a human driver or an electronic driver. The human driver can be the person operating the vehicle. The electronic driver can comprise a series of sensors connected to a central computer processor that reacts to the incoming information from the sensors(s) to control the vehicles motion. In some instances, there may be a human driver assisting an electronic driver. The vehicle can be for example a car, a motorbike, a bus a truck or a train. While the invention is defined in terms of a driver, it should be understood that any person that is required to obey the meaning of the signal system is intended to be included within the scope. In some embodiments, the person required to obey the signal is a rider. The rider can be riding an animal or a contraption. The contraption can be e.g. a bicycle or a scooter. The animal can be e.g. a horse. Alternatively, the person required to obey the signal is in a water going vessel such as a boat, and the signal assembly is located on a waterway. In some embodiments, the signal system is used to control persons on foot (e.g. pedestrians).

Using present traffic light systems, each human driver may react differently depending on their nature. For example, one driver may speed up when they see a red light, while another driver might immediately slow down. In embodiments, the traffic light assembly described herein is used to control the flow of traffic in transport hubs where all the vehicles are driverless. When all the vehicles are driverless, it can be inconvenient for each vehicle to behave differently, because the on-board computers require for predictable movements in order to make safe decisions themselves. Thus, the present system in embodiments is advantages because it allows for improved predictably in the response to the traffic light signals. Upon seeing a signal, the on-board processor of the vehicle is able to determine with consistency what action to take upon being exposed to a certain signal. For example, when an intermediate visual is detected, the driverless vehicle can identify that a signal is about to change and a new action is best not taken.

In an embodiment, the intermediate visual is a flashing sequence pattern. In an embodiment, the intermediate visual is motionless pattern-free light. There can be an intermediate visual between the transition of any one of the red to green lights, the green to amber lights and the amber to red lights. There can be an intermediate visual between every light colour change transition. In some embodiments, there is no intermediate visual between one of the colour change transitions.

The intermediate visual should be clearly distinguishable from the sequence patterns by a person looking at the signals.

In an embodiment, upon changing from red to green, the area changes from a red circle of light with flashing circles or crosses, to a green circle of light with flashing chevrons or moving lines. In an embodiment, an imminent change from red to green is indicated by an intermediate visual in the form of the circle or cross stopping flashing. There can then be a 1 or 2 second delay at that visual before the red light changes to the green light.

In an embodiment, upon changing from green to amber, the area changes from green with flashing chevrons or moving lines, to pattern free amber with no motion. In this embodiment, the pattern free amber with no motion is the intermediate visual. The motionless intermediate visual communicates to the driver that the light has just changed and that it is reasonable to continue through the intersection. A driverless vehicle may be alerted that a change is coming but that continued movement is appropriate. After a predetermined time period, the motionless amber transitions to an area with flashing dots. Upon seeing these dots, all drivers should be alerted that it is now appropriate to prepare to stop.

In an embodiment, upon changing from amber to red, the area changes from amber with flashing dots to red with no motion. In this embodiment, the pattern free red with no motion is the intermediate visual. The motionless intermediate visual communicates to the driver that the light has just changed and that, whilst it is not reasonable to continue through the intersection, it is at least forgivable under some circumstances since the light only just changed (a fine would still be issued). After a predetermined time period, the motionless red transitions to an area with flashing circles or crosses. All drivers are now stopped.

The light of the traffic light assembly can be emission of light form one light source such as a screen or a bulb (or other light emitting device). Typically, if a bulb is used it can be an incandescent halogen bulbs rated at between 50 and 150 watts. The overall impression is preferably a circle of light, which is the common shape that motorists are used to seeing while driving. The circle can be displayed on a screen of any shape. The screen can be circular or the screen can be square. Alternatively, a plurality of small bulbs or diodes can together provide the overall impression of the substantially circular red light in the traffic light assembly. Many of the traffic light signals on the streets today are made out of arrays of light emitting diodes (LEDs). These are tiny, purely electronic lights that are extremely energy efficient and have a very long life. Each LED is about the size of a pencil eraser, so hundreds of them can be used together in an array.

The pattern created in the light can be by creation of a visual interruption in the light source. For example, a screen displaying the red circle of light can be adapted to display a red circle of light with a flashing circle therein. A bulb displaying a red circle of light can have a flashing circle overlaid e.g. by a second annular bulb disposed in the light pathway. Alternatively, the plurality of small LED lights (preferred) can be caused to flash the pattern in a sequence.

The flashing can be in any colour that is different from the background colour. The flashing can be white light. The flashing can be caused by a brief period of "no light" from a certain section, where lights in the desired pattern are temporarily stopped from emitting light to give the impression of flashing.

The use of either white or black markers (white being flashes and black being a sudden lack of light) within the traffic light may best suit colour blinded drivers to see the enhancement and provide whichever contrast is the better. Colours of dots in the flashed pattern may be brilliant white or black or another contrasting colour to the background lights in the set of signals The contrasting flashing dots within the yellow or red lights may require adjustment and or tweaking to allow the best result for colour blind persons. This may equally apply to a driver where Ïrlen Syndrome is present. For example, the combination of red and white may not be the optimum choice for the display, since these two colours may blend without the aid of prescription glasses. This blending phenomena may also apply to other combinations of colour; however, the black dots contrasting the red and orange light are more likely to be discerned by both categories of driver (and may appear grey to black-looking), but should always contrast with the background. The further knowledge, for example, that two flashing rings are within a red light and one flashing circle of contrasting colour is within an orange light should assist in discerning the colour. This universally allows all drivers to react with a reasonably straight forward response. This can be determined based on trial and error and with the location of the particular traffic light in mind. E.g. Black on red may not be as effective as bright white dots in the circle. Similarly black on orange may be better than bright white dots to reinforce the meaning of the orange light with only one precautionary flashing circle of markers.

The dots used to create the pattern in the light can be continuous or alternatively placed in the flashing circle whichever is the more effective for that colour background.

By using the traffic light assembly of an embodiment of the present invention, it is envisaged that there may be a reduced numbers of accidents and death rates at intersections where traffic converges. There may also be a resultant reduced amount of damage to the traffic light poles. There may be fewer road rage incidents at intersections. There may also be better traffic flow at intersections.

A universal system is provided with indicators that everyone should be able to understand. This system should grab the attention of every motorist. An enhancement of an existing system is provided which colour blind, distracted, tired and or incompetent drivers or even drivers suffering from Men syndrome can be alerted to and can acknowledge with the correct response. The signals are a sign language that all motorists should understand and interpret—and can follow with the correct driving response.

For driverless vehicles such as cars, the software on board the vehicle can be programmed to use the existing signal system currently used on roadways. The sensors of the driverless vehicle can be further programmed to detect the system of embodiments of the present invention. In one embodiment, the driverless vehicle can detect one flashing solid ring (or intermittent ring flashing) as the orange/yellow caution light. The driverless vehicle can be programmed to detect two flashing solid rings (or intermittent flashing dots) or crosses as a stop sign (red). The green trickle signal (chevrons or lines) can be detected by the driverless car as a signal to proceed. The flashing signals in all forms thereby become a unique code sent to the sensors of the driverless vehicle that are independent of colour. This code can be varied as required to best meet the needs of the vehicles. The advantage of being independent of colour is that the sensors and computer on board the driverless vehicle do not have to interpret colour. The interpretation of colour by a computer sensor can be difficult, particularly in low light or when there are other environmental influences that change the way in which the colour might be perceived.

BRIEF DESCRIPTION OF THE FIGURES

Embodiments of the invention will now be described with reference to the accompanying drawings which are not drawn to scale and which are exemplary only and in which.

DETAILED DESCRIPTION OF EMBODIMENTS OF THE INVENTION

Figure 1:
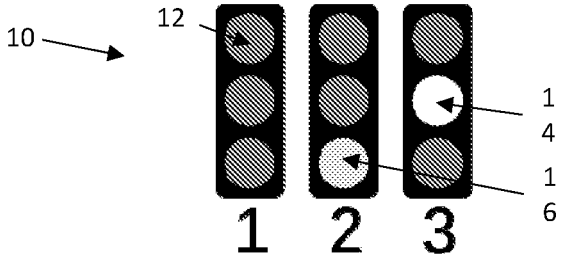
FIG. 1 is a schematic view of traffic light signals that can be subject to embodiments of the invention.

As shown in FIG. 1, the traffic light signals 10 can be of the type having three lights 12, 14, 16 arranged in a stack, with the topmost light being capable of emitting red light (1), the middle light being capable of emitting amber light (2), and the bottom light being capable of emitting green light (3). The image in FIG. 1 shows three traffic light assemblies, each with one light activated. These are the traffic lights that are most common in countries around the world. However, any orientation of traffic lights could be used as would be understood upon reading the description herein.

It is generally understood that a red light in a traffic light assembly means stop. The red light should be clearly transmitted to the person required to obey the traffic light.

In the present sequencing, when the red light is first activated, the light can be motionless for a predetermined period of time. The predetermined period of time can be at least 30, 60, 90, 120 seconds. The user will see a red light with no sequence pattern. This period of no pattern can be considered an intermediate visual.

Figure 2:
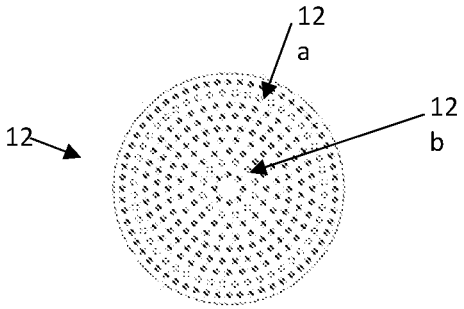
FIG. 2 shows a close up of the red light of an embodiment of the invention.
Figure 7:
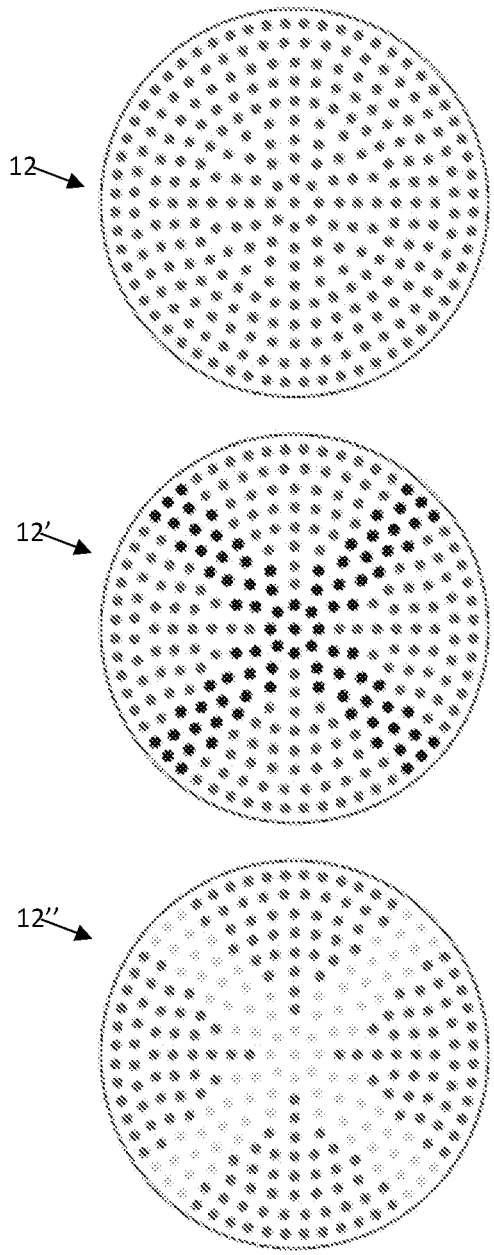
FIG. 7 shows a sequence of a pattern in the red light.

After the predetermined period of time has elapsed, a pattern can be displayed. The pattern can be a flashing circle of light. FIG. 2 shows an example of a red light 12 with a circular flashing pattern 12*a*, 12*b*. FIG. 7 shows an example of a red light 12 with a cross flashing pattern. In FIG. 7 the sequence of a cross pattern is shown. The arrow shows the direction of the sequence. The pattern starts with image 12 which is red steady state light. The sequence then moves downwards to 12' and 12" in the direction of the arrow. Image 12' is a cross pattern of LED lights turning on and off. Image 12" is the cross pattern of LEDs retuning back to red light.

The red light can have at least one flashing circle of lights or a flashing cross within the outer periphery of the red light. In some embodiments there is more than one flashing circle such as two flashing circles arranged concentrically. There can be more than two flashing circles depending on the size of the red light. These flashing circles can serve to alert the motorists to the stop signal.

In an arrangement in which the red light is formed from a plurality of concentric diodes, an inner circle pattern can be formed from light emitted/omitted from one row (annular) of diodes preferably one row in from the centre of the red light; and another flashing circle will be preferably be one row (annular) in from the outer circumference of the light. The circle can be provided by the circular arrangement of lights emitting a new colour of light that contrasts with the red light. The new colour can be e.g. white. Alternatively, the circle pattern can be provided by the circular arrangement of lights being inactivate i.e. omitting to display light (i.e. emitting no, or very low light). The lack of light may appear as black.

As shown in FIG. 2, there are two concentric circles 12*a* and 12*b* formed within the red light area.

Two flashing circles of light means red. Two flashing circles of light mean stop to all motorists.

Running a red light is a problem and can be the cause of many and major accidents. The flashing dots on the red light may serve to emphasizes the danger of proceeding through the road way. The flashing dots can serve to make the stop more imperative and meaningful. In some instances, it is thought that the flashing nature of the light will alerts tired drivers.

It can be considered a more deliberate action if the driver runs a red light when the dots forming the circle are flashing. It will be a direct defiance of the red signal and should not only attract a fine but also a higher point penalty to bring home the message that STOP means STOP. In relation to driverless vehicles, the flashing signal in the red light can allow the sensors on board the vehicle to be programmed to double check not only colour, but also the flashing sequence associated with the colour. This in built fail safe can allow the driverless vehicle to more easily interpret the meaning of an upcoming traffic signal.

The dots forming the circular pattern can flash continuously the whole time the red light is illuminated. The circles can flash alternately. The dots (bulbs) forming the circle could flash as a solid ring or as an intermittent ring. The dots could be programmed to snake around as a circle. Flashing white dots in the red light are a no go at any time. It will be different to a flashing red light and it's meaning at construction sites and elsewhere.

The sequence pattern can be programmed to control the traffic light signal assembly using a Programme Logic Controller (PLC). The PLC can be programmed by the road traffic Manager to provide the required sequence that matches with the traffic conditions in that area. The program can be amended or adapted if the users find that the light sequence is not working effectively.

It is generally understood that the amber colour in a traffic light assembly means continue only if unable to stop safely.

Some driver's find the amber light confusing, because the action to be taken can depend on how long the amber light has been on display. An early amber light might be passable, while a late amber light (that has been displayed for some time) requires an immediate stop.

When the amber light of the present signal system is first activated, the light can be motionless for a predetermined period of time. The predetermined period of time can be at least about 1 or about 2 seconds. Longer delays can be utilised but shorter times are preferred given that the amber light (as compared with the red and green) is only displayed for a relatively short time frame in the sequence pattern. This period of no pattern can be considered an intermediate visual.

After the predetermined period of time has elapsed, a pattern can be displayed. An example of the pattern 14*a* is shown on the amber light 14 in FIG. 3.

Figure 3:
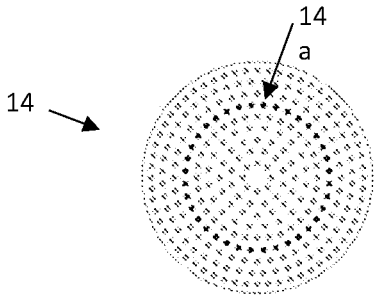
FIG. 3 shows a close up of the amber light of an embodiment of the invention.
Figure 4:
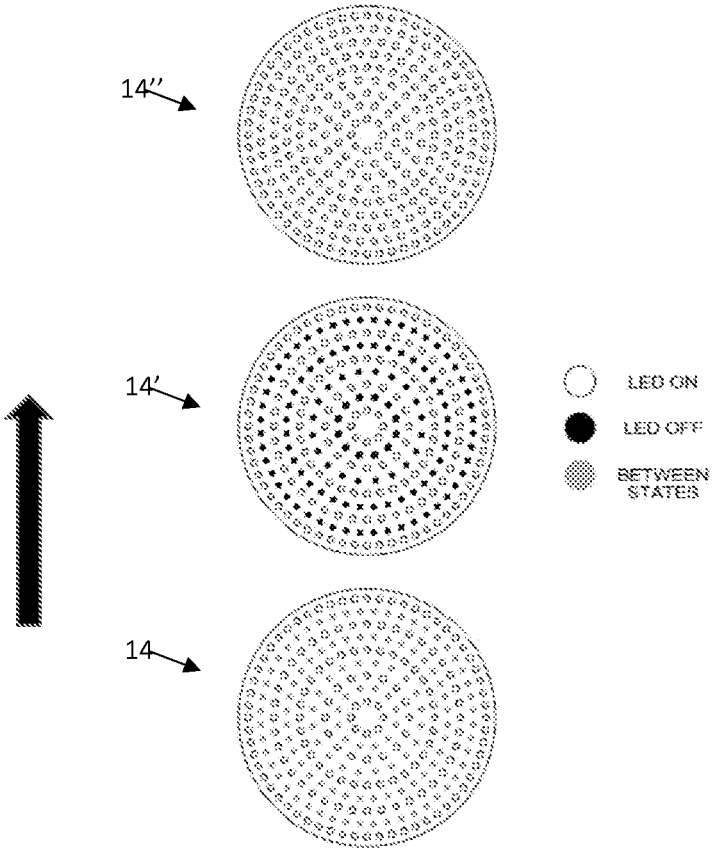
FIG. 4 shows an amber light in accordance with FIG. 3 in the context of the traffic signal arrangement.

The pattern can be an annular representation of flashing dots of light/no light. This is shown in FIG. 3 as 14*a*. The pattern can comprise flashing black or white dots which will activate after the timed delay. The dots can be in a circle or ring pattern 14*a*. The dots can be either solid or intermittent alternative pixels. The intermittent pixelated circles can change over time giving the illusion of a moving circle rotating within the area of light. In FIG. 4, a moving pattern of circles within the amber area can be envisaged. The sequence of events over time as the light changes is represented by the arrow.

The flashing ring of alternate dots or a complete circle of dots within the amber light should in some cases make the meaning of the colour amber more evident. Amber light with dots flashing in a circular array after 1 (or 2) seconds delay emphasizes it is NOT safe to proceed and pulling up is the optimum and desired action for all users to ensure road safety. Amber then may become an extra warning to unattentive drivers that there is no time left to enter the intersection and that red is about to appear. It would be considered to be illegal then to run the amber light after about 1 second when the "Go" or "No Go" option is compromised. Flashing indicators on the amber light translates to "Slow down NOW" and "Stop NOW" as per the red light that follows. The discretion that involves speed through the light is now gone or is at least compromised; flashing dots have assisted in the decision making.

The concept that "motorists must stop on yellow (amber) light unless it is unsafe to do so" has not changed; it has just been enhanced by a reminder of the flashing pattern of an embodiment of the present invention. Hence the flashing dots will allow anyone too close to the set of lights to proceed in the first few seconds of the amber light appearance, and pass over the intersection before the amber becomes red and before the flashing pattern appears. After that 1 or 2 second interval the flashing dots on the amber will remind the driver to STOP immediately. After that first second of amber elapses, EVERY vehicle must slow down and prepare to stop. It is thought that the drivers mind is alerted to this fact by the flashing dot pattern. It is thought that the motorists will be less likely to misjudge the situation; the flashing pattern will educate them. The flashing dot pattern indicates that there is NOT enough time to get through the intersection. The flashing lights have done the calculation for the drivers; there is arguably no more thinking they have time to get through the intersection safely.

Once the flashing amber light pattern has begun after 1 (or 2) second interval the countdown to red is typically more obvious and a jolting reminder to the driver to STOP. The second(s) delay with the amber light is to attempt to avoid accidents at intersection and may allow vehicles on the speed limit at the white line for the lights to proceed across the intersection for the remaining duration of the amber light. After the intermediate visual prior to the ring of flashing lights, the pattern of flashes will activate and continue to flash to slow and halt all vehicles as it times up the red light.

In addition to acting as a communication tool for traffic light change, if the set of traffic lights at the intersection are not working then the amber light could flash alone with alternate blinking dots to remind the motorist approaching this signal that you "must" slow down (if not come to a stop) and give way to traffic as though you are at an intersection with STOP signs. This could eliminate the need for manual traffic control. Black flashing dots around and inside the perimeter could mean the same as an octagonal STOP sign or a STOP sign painted on the road.

It is generally understood that a green light in a traffic light assembly means go. By "go" it is meant that the driver can move past the signal.

Figure 5:
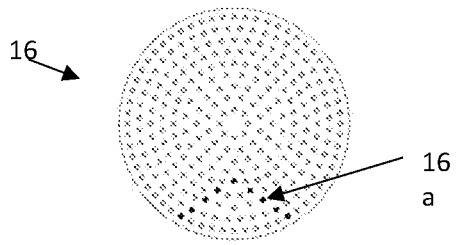
FIG. 5 shows a close up of the green light of an embodiment of the invention.
Figure 6A:
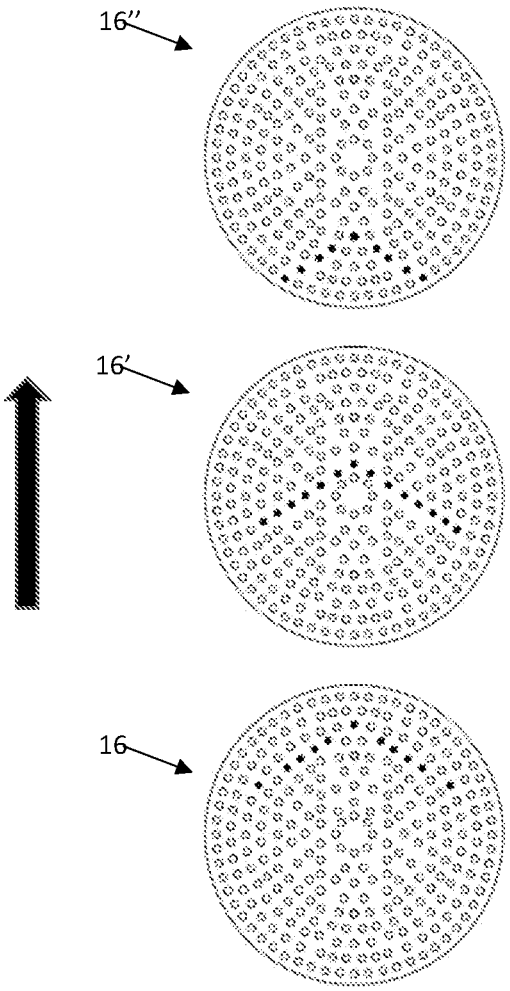
FIG. 6*a* shows the sequence of a pattern in the green light.
Figure 6B:
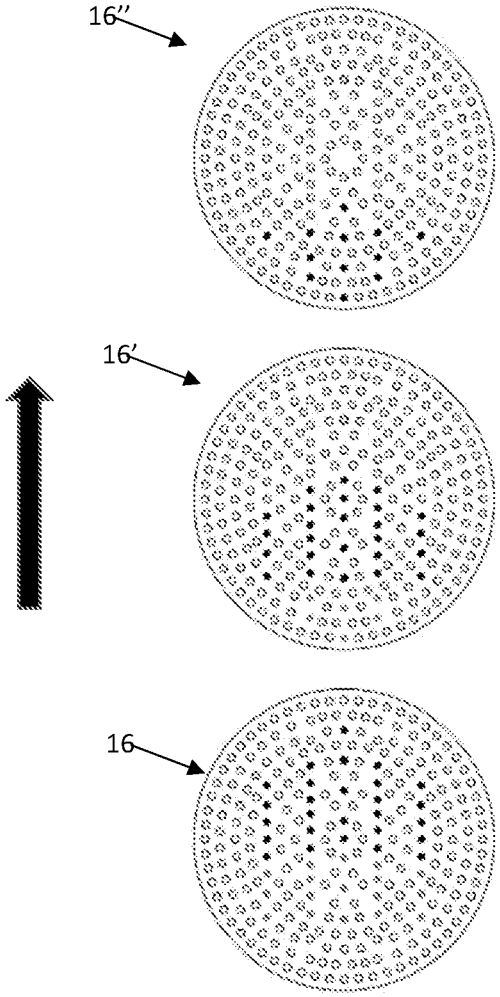
FIG. 6*b* shows an alternate sequence of a pattern in the green light.

When the green light is first activated, the light can comprise chevrons running up the centre of the face of the light. This is shown in FIG. 5 where the green light 16 is shown with (a part of) a chevron pattern 16*a*. In FIG. 6*a*, the sequence of the chevron pattern 16*a* is shown. The arrow shows the direction of the sequence. The pattern starts with image 16 and then moves upwards to 16' and 16". Alternatively, two to five (or any number) of broken lines can trickle up the light as can be seen in FIG. 6*b*, 16, 16', 16". This moving pattern should alert motorists of a change in signal status and should inspire drivers to move forward especially if some drivers were texting sitting at the red light, or just day dreaming.

The pattern of lights in each of the colours can be different so as to distinguish the message delivered to drivers.

The pattern of light colour change from green to amber to red, and back to green (on a cycle) can cycle many hundreds of times. The timing of each colour is predetermined according to the nature of the intersection. The intermediate visual provided between each colour serves as a warning to drivers that the light is about to change and in some embodiments provides a clear interruption signal. The light signals may become much more effective than traditional signals since they are able to communicate much more than stop and go, and instead are able to communicate information about the transition state of the light cycle.

These markers will in embodiments make it safer for all drivers at intersections where there are traffic lights as they will enhance the meaning of the signal and make the drivers more alert to their circumstances; give colour blinded drivers accurate signals and oblige everyone to drive lawfully A display of pulsating dots within a particular colour can attempt to change all drivers perception and in some cases their actions would become more appropriate and safer for themselves other road users and pedestrians.

The enhanced signal is intended to emphasise the meaning of the signal and to stimulate the driver's awareness of their surroundings to allow them to better interpret the signal; react to the signal; take the correct action from that enhanced signal; and therefore act appropriately and satisfy the legal requirements of the actual signal.

The drivers would in principle be able to make better decisions if they are made aware of their obligations by an alert system within the traffic signals.

This new version of traffic lights described herein relates to the existing signal system for vehicle operations and regulation. The lights use existing traffic signals and attempt to enhance their warning capability to improve pedestrian and vehicle safety especially at intersections. In relation to pedestrians, where there are no count down indicators at crossings, the pedestrian attempting to cross the road may be more readily be able to discern whether it is safe to cross by looking at the flashing sequence that is currently being displayed.

These smart lights attempt to enhance an existing light system to improve the safety feature of traffic lights. These designs are meant to be eye catching rather than just be an inert static display that drivers sometimes do not heed properly.

For driverless vehicles, the signals can assist and promote in the interpretation of the meaning of the upcoming traffic signal. The signals can also be programmed with additional information available to the driverless vehicle. For example, the speed of the flashing (number of flashes per second, or per 5 seconds) can be an indicator of the length (in meters) of the intersection. The speed of the flashing may not be discernible to a human driver, but could convey valuable information to the driverless vehicle. For example, the vehicle may need to adjust its speed for very long intersections in order to ensure the intersection is traversed without undue delay. The additional information in the flashing sequences may relate to the number of accidents at the intersection, which the driverless vehicle can process and then take additional caution if it is an accident blackspot. The additional information in the flashing sequence could be rapid firing of lights (or a pattern of lights) undetectable to anyone other than the driverless vehicles, but which could act as a warning that there are cyclists present, or school children crossing, or other. In an embodiment, the speed of the flashing can indicate that the light is moving to a new signal in the sequence. For example, when the red light is about to transition to the green light, the intermediate visual could be The reinforcing of an existing system is achieved for all drivers as follows:

- Because of the EXTRA warning background features on the traffic lights there could in some instance be less confusion with peripheral neon lights nearby.
- Traffic signal is enhanced by the animation and in embodiments the emphasis is more evident and makes the meaning of the colour indicated clearer.
- This would be especially significant on the Amber and Red light animations for:
  - Drivers with limited eyesight from current illness or stress.
  - Distracted persons whose alertness has altered.
  - Drug affected drivers also whose alertness faltered.
  - Alcohol affected drivers who need a hint to make them more aware of their circumstances.
  - Stress affected drivers whose concentration has lapsed temporarily.
  - Tired drivers who need reminding of their responsibilities behind the wheel.
  - New drivers who would benefit from the assistance of the flashing dots.
  - Convicted drivers who are back to P plates for better judgement at continuing to obey all traffic signals.
- The flashing black or white dots should not affect red light cameras for speeding fines.
- The flashing black or brilliant white dots on the lights for drivers in air-conditioned closed vehicles become a perceptual aid like auditory and or tactile signals.
- The flashing dots would more likely help drivers to approach the intersection at a safer speed.
- The flashing black dots are a reminder also to always approach at a safe speed in case the signal changes before you reach the intersection.
- The flashing system is a code that can be used to assist driverless vehicles to interpret traffic signals independent of colour or as a complement to a detected colour.

As shown in the Figures, there is a traffic light assembly 10 comprising a light signal adapted to emit red 12, amber 14 and green light 16 in a sequence. The light signal is capable of communicating to a driver (or other road user) (not shown) that an action is required to be undertaken at a location on a road (not shown). The communication is by a change in light colour using a universal system that is well known to all drivers. The light signal comprises an area from which light is emitted. The area is typically a series of circles, each circle adapted to emit a different colour. While the light is being emitted, a flashing sequence pattern is generated within the area to enhance the meaning of the signal communicated to the driver. The sequence pattern is formed by changing the colour of some of the light being emitted, and or by ceasing to emit some of the light, and so that the sequence pattern displayed during emission of red, amber or green light is different in each configuration. As can be seen in FIGS. 2, 3, 5 and 7, a change in colour of the light (or omission of some of the light) can be used to form patterns in the coloured area. An intermediate pattern is provided in the area at a transition between at least one of the red, amber and green lights in the sequence. The intermediate pattern can be a lack of pattern. The intermediate pattern is noticeable because it is different in configuration from any of the green, amber or red sequence patterns. The intermediate pattern seeks to further communicate to the driver that the light signal is about to change and that action is about to be required.

The invention also comprises a method of controlling traffic. The method can comprise providing a traffic light assembly according to the present invention. In an embodiment, the method comprises programming a PLC to control the traffic light assembly. The program to control the light signal assembly can cause a flashing sequence pattern to be generated within the area to enhance the meaning of the signal communicated to the driver. The sequence pattern is formed by causing a change in the colour of some of the light being emitted, and or by ceasing to emit some of the light, and so that the sequence pattern displayed during emission of red, amber or green light is different in each configuration. The program can also cause display of an intermediate pattern that is different in configuration from any of the sequence patterns to be provided in the area at a transition between at least one of the red, amber and green lights in the sequence. The intermediate pattern can be to further communicate to the driver that the light signal is about to change and that action is about to be required.

Any promises made in the present description should be understood to relate to some embodiments of the invention, and are not intended to be promises made about the invention. Where there are promises that are deemed to apply to all embodiments of the invention, the right is reserved to later delete those promises from the description since there is no intention to rely on those promises for the acceptance or subsequent grant of a patent unless the context makes clear otherwise.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A traffic light assembly comprising a light signal adapted to emit red, amber and green light in a sequence; the light signal being capable of communicating to a driver by a change in colour that an action is required to be undertaken at a location on a road;

wherein the light signal comprises an area from which light is emitted;

wherein, while the light is being emitted, a flashing sequence pattern comprising one or more shapes including at least one of cross, circle and chevron, is generated within the area to enhance the meaning of the light signal communicated to the driver;

wherein the flashing sequence pattern is formed by at least one of changing the colour of some of the emitted light and ceasing to emit some of the emitted light, and wherein the flashing sequence pattern displayed during emission of red, amber or green light is different in each configuration; and wherein an intermediate visual comprising a motionless pattern-free light that is different in configuration from any of the flashing sequence patterns, wherein the motionless pattern-free light is provided in the area at a transition between at least one of the green-to-amber and amber-to-red light changes in the sequence for a predetermined time period of at least about one second, to further communicate to the driver that the light signal is about to change and that action is about to be required.

2. The traffic light assembly of claim 1, wherein the flashing sequence pattern displayed during emission of red, amber or green light comprises:

when the light is red, at least one flashing circle or cross pattern within the area intended to communicate a stop action to the driver;

when the light is amber, at least one flashing circle pattern within the area intended to communicate a stop action to the driver; and when the light is green, one or more chevrons moving over the area intended to communicate a move forward action to the driver.

3. The traffic light assembly of claim 1, wherein upon changing from red to green, the area changes from a red circle of light with flashing circles, to a green circle of light with flashing chevrons or moving lines.

4. The traffic light assembly of claim 1, wherein upon changing from green to amber, the area changes from green with flashing chevrons or moving lines, to pattern-free amber with no motion.

5. The traffic light assembly of claim 4, wherein the pattern-free amber with no motion is motionless for a predetermined period of time of at least about one second.

6. The traffic light assembly of claim 1, wherein upon changing from amber to red, the area changes from amber with flashing dots to red with no motion.

7. The traffic light assembly of claim 6, wherein the red with no motion is motionless for a predetermined period of time comprising a duration selected from the group consisting of at least about 30, 60, 90, and 120 seconds.

8. The traffic light assembly of claim 1, wherein light is emitted from an array of light emitting diodes (LEDs).

9. The traffic light assembly of claim 1, wherein at least one of the flashing sequence patterns is formed by flashing white light.

10. The traffic light assembly of claim 1, wherein at least one of the flashing sequence patterns is formed by causing omission of light.

11. A method of controlling traffic using the traffic light assembly according to claim 1.

12. The traffic light assembly according to claim 1, further comprising a program configured to implement at least one of the light signal, the flashing sequence pattern, and the intermediate visual.

13. The traffic light assembly according to claim 12, wherein the program is implemented by a Programme Logic Controller (PLC).

14. A method of controlling a driverless vehicle comprising programming the driverless vehicle to respond to the traffic light assembly according to claim 1.

* * * * *